US007056469B2

(12) United States Patent
Nosbisch

(10) Patent No.: US 7,056,469 B2
(45) Date of Patent: Jun. 6, 2006

(54) STARTER SET FOR BRICK LINING OF LADLES USED IN HANDLING MOLTEN METAL

(75) Inventor: Lee A. Nosbisch, Chester, VA (US)

(73) Assignee: North American Refractories Co., Moon Township, PA (US)

( * ) Notice: Subject to any disclaimer, the term of this patent is extended or adjusted under 35 U.S.C. 154(b) by 130 days.

(21) Appl. No.: 10/699,535

(22) Filed: Oct. 31, 2003

(65) Prior Publication Data

US 2005/0093212 A1 May 5, 2005

(51) Int. Cl.
*C21B 7/04* (2006.01)
*C21C 5/44* (2006.01)
*C21B 7/06* (2006.01)

(52) U.S. Cl. ..... 266/283; 266/280; 266/275

(58) Field of Classification Search ..... 266/280, 266/275, 283

See application file for complete search history.

(56) References Cited

U.S. PATENT DOCUMENTS 2,818,248 A * 12/1957 Kelsey ..... 266/283
3,393,482 A * 7/1968 Hannah ..... 52/249
3,851,772 A * 12/1974 Williamson et al. ..... 414/732
3,972,516 A * 8/1976 Napora ..... 266/283
5,824,263 A * 10/1998 Erny et al. ..... 266/283
5,882,583 A * 3/1999 Erny ..... 266/283

FOREIGN PATENT DOCUMENTS

DE 2558033 A * 3/1977

* cited by examiner

*Primary Examiner*—Scott Kastler
(74) *Attorney, Agent, or Firm*—Kusner & Jaffe

(57) ABSTRACT

A lining for a ladle used to handle molten metal. The lining is comprised of a first course of like, refractory bricks arranged horizontally in the ladle, the first course having an upper surface. A second course of like refractory bricks is arranged to spiral within the ladle. The second course is disposed on the first course, and the second course has an upper surface. A starter comprised of at least one refractory component is dimensioned to form a contoured ramp surface. The starter is disposed between the first course and the second course of like refractory bricks. The ramp surface at one end of the starter set is aligned with the upper surface of the first course and the ramp surface at another end is aligned with the upper surface of the second course.

20 Claims, 6 Drawing Sheets

STARTER SET FOR BRICK LINING OF LADLES USED IN HANDLING MOLTEN METAL

FIELD OF THE INVENTION

The present invention relates generally to refractory linings for metallurgical vessels, and more particularly, to a starter set of refractory components for lining the wall of a ladle used to handle molten metal.

BACKGROUND OF THE INVENTION

The handling of high-temperature molten metal, such as steel, requires special materials and techniques. Ladles used for handling molten steel are comprised of an outer metal shell that is lined with a refractory material. The inner surface of the metal shell is typically lined with one or more layers of a refractory brick that can withstand extremely high temperatures and harsh, abrasive conditions. It is known to use a "starter set" of refractory components to cause the bricks within the ladle to spiral along the inner surface of the ladle. The starter set makes construction easier by eliminating the need to key bricks as is required for stacked courses of bricks.

A problem with conventional starter sets is that they form a generally linear ramp. The ramp is disposed at an angle relative to the surface of other bricks in a course that is arranged in a generally horizontal plane. Each end of the ramp abuts refractory bricks that are arranged horizontally. As bricks are stacked onto the ramp, they meet a row of horizontal bricks thereby creating a "hump" in the lining. Subsequent layers of brick exaggerate the hump, as illustrated in FIG. 2. In other words, a slight crack or gap is formed where the starter set meets horizontal bricks, and gaps increase as upper layers of brick are stacked thereon. As will be appreciated, such gaps in the brick lining create an opening where molten metal may penetrate through the refractory lining to the metal shell.

The present invention overcomes this problem, and provides a starter set of refractory components for lining the wall of a ladle that eliminates the severe spacing problem created by starter sets known heretofore.

SUMMARY OF THE INVENTION

In accordance with a preferred embodiment of the present invention, there is provided a starter set of refractory components for starting a spiral brick lining in a ladle used for handling molten metal. The starter set is comprised of a plurality of refractory components. Each component has a planar bottom surface, an upper surface and end surfaces. The components are dimensioned to be arranged end-to-end wherein the end surface of a component facing an adjacent component is dimensioned to mate with the end surface of the adjacent component. The upper surfaces of the refractory components are alignable to form a continuous, outwardly bowed upper surface profile.

In accordance with another aspect of the present invention, there is provided a starter set of refractory components for starting a spiral course of lining bricks in a ladle used for handling molten metal. The starter set is comprised of a plurality of refractory components that are dimensioned to be assembled together to form a non-linear, contoured ramp surface having a leading end and a trailing end. The refractory components are dimensioned such that the leading end of the ramp surface is alignable with an upper surface of a first course of lining bricks in the ladle and the trailing end of the ramp surface is alignable with an upper surface of a second course of lining bricks in the ladle. The second course of lining bricks is disposed on the first course of lining bricks.

In accordance with yet another aspect of the present invention, there is provided a lining for a ladle used to handle molten metal. The lining is comprised of a first course of like, refractory bricks arranged horizontally in the ladle, the first course having an upper surface. A second course of like refractory bricks is arranged to spiral within the ladle. The second course is disposed on the first course, and the second course has an upper surface. A starter comprised of at least one refractory component is dimensioned to form a contoured ramp surface. The starter is disposed between the first course and the second course of like refractory bricks. The ramp surface at one end of the starter set is aligned with the upper surface of the first course and the ramp surface at another end is aligned with the upper surface of the second course.

An advantage of the present invention is a starter set of refractory components for creating a spiral brick lining along the side of a ladle that is used in handling molten metal.

Another advantage of the present invention is a starter set of refractory components as described above that eliminates the spacing and gap problems in upper layers of brick created by linear starter sets known heretofore.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
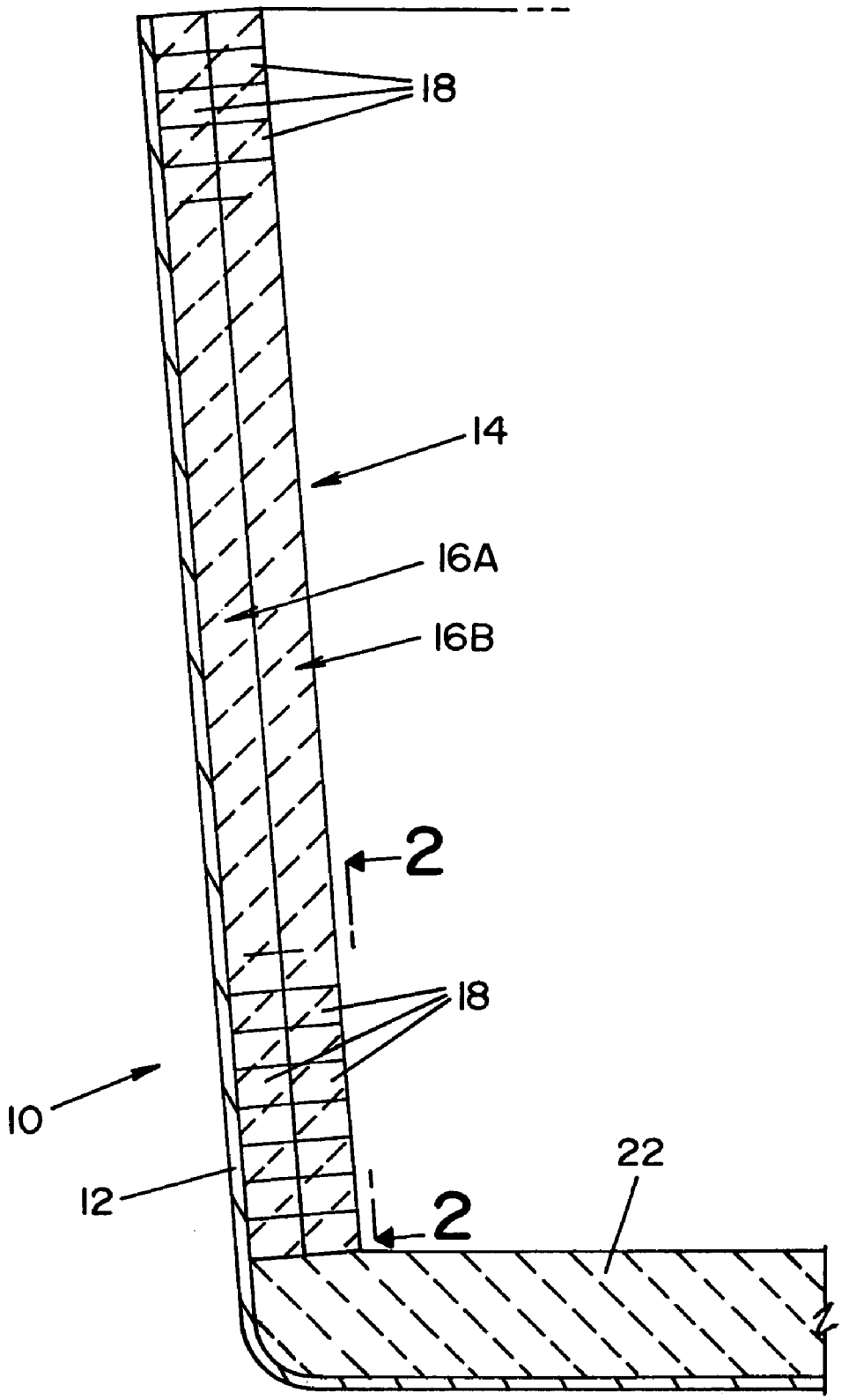
FIG. 1 (PRIOR ART)
FIG. 1 is a partial, side sectional view of a ladle for handling molten metal, showing a conventional interior brick lining.

Referring now to the drawings wherein the showings are for the purpose of illustrating preferred embodiments of the invention only, and not for the purpose of limiting same, the present invention relates generally to a refractory lining for a metallurgical vessel. The invention is particularly applicable to a refractory lining for a steel ladle used in handling molten metal, and will be described with particular reference thereto. It will be appreciated from a further reading of the specification that the invention is not limited to a steel ladle, but may find advantageous application in linings used in other types of circular, metallurgical vessels for handling molten metal.

Figure 2:
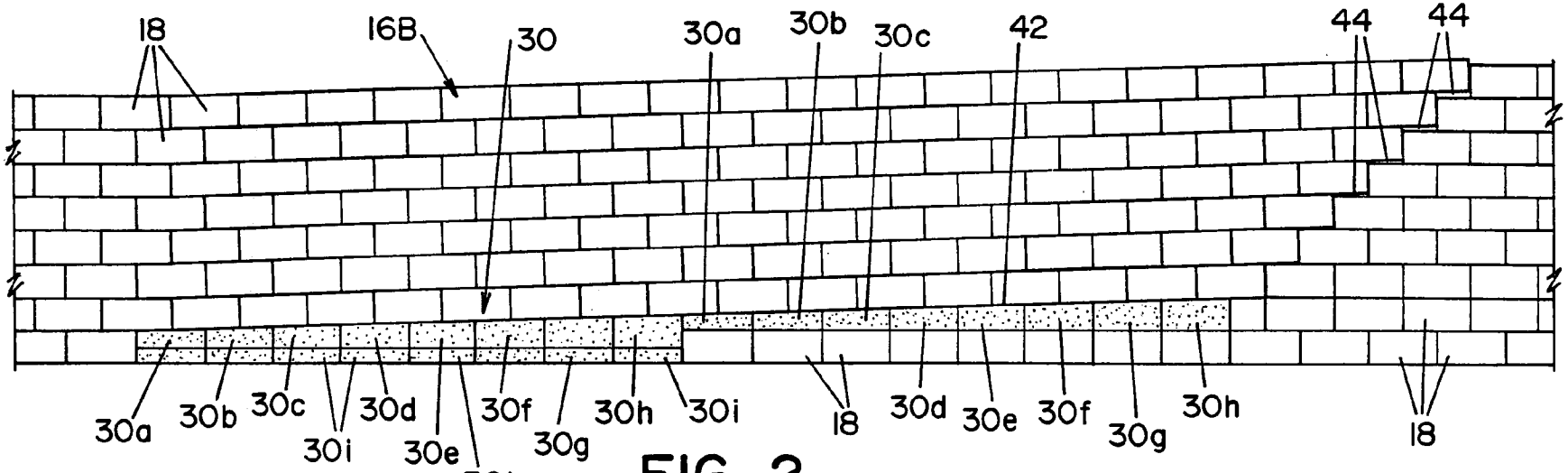
FIG. 2 (PRIOR ART)
FIG. 2 is a view taken along lines 2—2 of FIG. 1, showing a brick lining in planar relief, showing a conventional starter set having a linear upper surface.

FIG. 1 shows a portion of a conventional steel ladle 10 having an outer metallic shell 12 and an inner refractory lining 14. In the embodiment shown, lining 14 is comprised of two layers 16A, 16B of refractory brick 18. The ladle has a bottom lining 22 comprised of a layer of cast refractory material. FIG. 2 is a developed view of a portion of the innermost surface of the brick lining 16B of FIG. 1, showing a conventional starter set 30 of refractory components for initiating a helical, spiral brick lining. Starter set 30 shown in FIG. 2 includes twenty four (24) refractory components having nine (9) different shapes 30*a*, 30*b*, 30*c*, 30*d*, 30*e*, 30*f*, 30*g*, 30*h* and 30*i*. In this respect, in FIG. 2, like refractory components are designated with like reference numbers. The upper surfaces of the refractory components define a ramp surface 42 that is generally planar. As will be appreciated by those skilled in the art, since a steel ladle is generally cylindrical in shape, ramp surface 42 of starter set 30 is a planar, helical surface. Refractory lining bricks 18 above starter set 30 are inclined, at an angle, relative to lining bricks 18 at the end of the starter set. In this respect, lining bricks 18 at the end of starter set 30 are generally horizontally disposed. As a result, a gap or crack 44 in lining bricks 18 is formed where starter set 30 and bricks 18 set thereon, meets horizontal lining bricks 18, as illustrated in FIG. 2.

Figure 3:
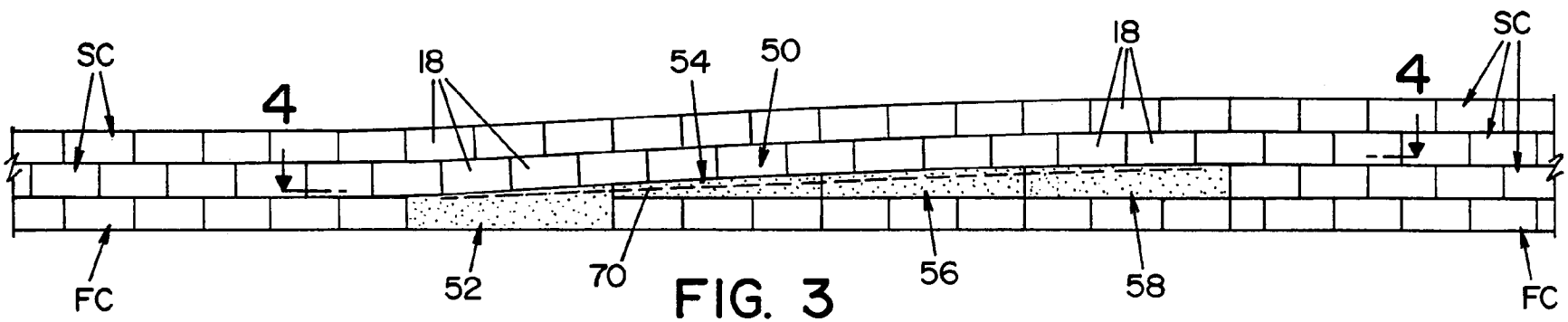
FIG. 3 is a view of a lining of a ladle showing a starter set according to a preferred embodiment of the present invention.

Referring now to FIG. 3, a starter set 50 illustrating a preferred embodiment of the present invention, is shown. In the embodiment shown, starter set 50 is comprised of a plurality of refractory components. In the embodiment shown, the four (4) refractory components 52, 54, 56, 58 form starter set 50. As will be appreciated from a further reading of the specification, starter set 50 may have a different number of refractory components. Each refractory component 52, 54, 56, 58, as best seen in FIGS. 4 and 5A–5D, is a single uniform element.

Figure 4:
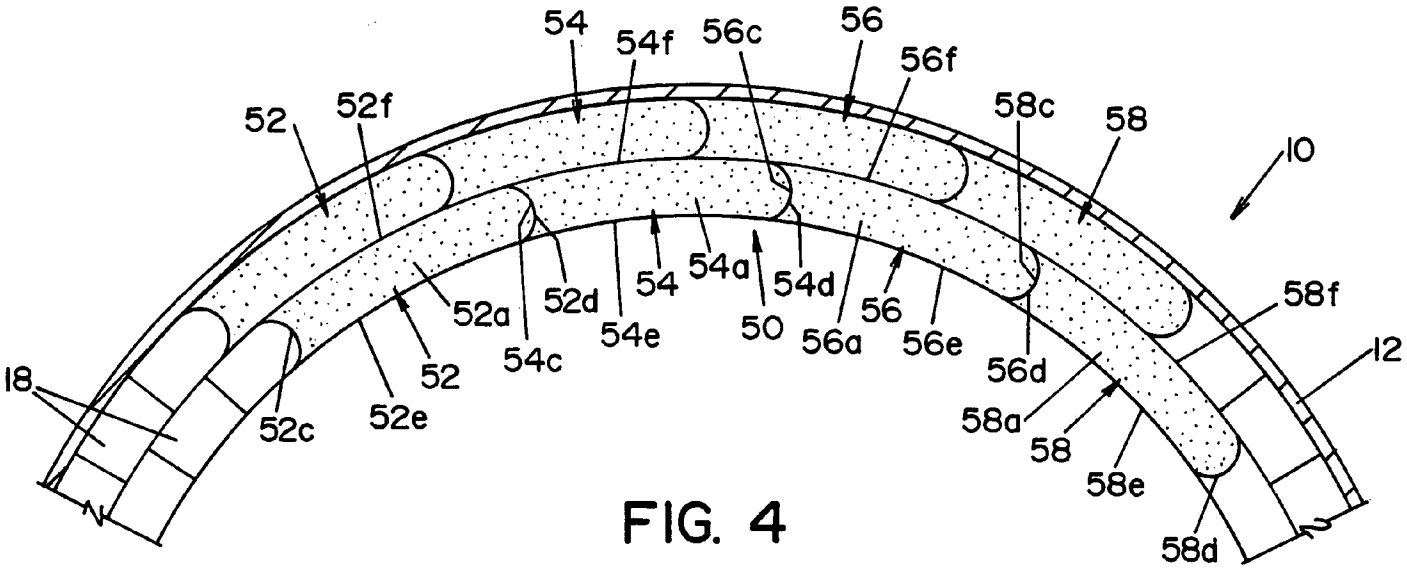
FIG. 4 is a view taken along lines 4—4 of FIG. 3 showing the two starter sets, side-by-side, in plan view.
Figure 5D:
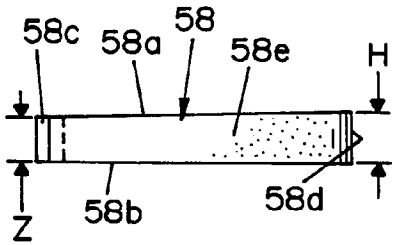
FIGS. 5A through 5D are side, elevational views of the individual components forming a starter set shown in FIG. 3.
Figure 5C:
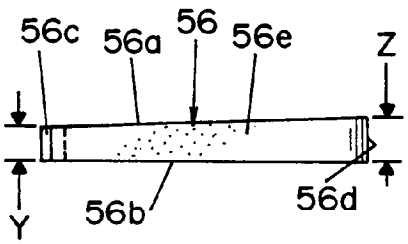
Figure 5B:
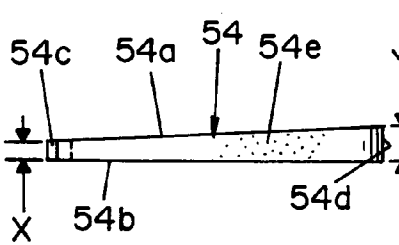
Figure 5A:
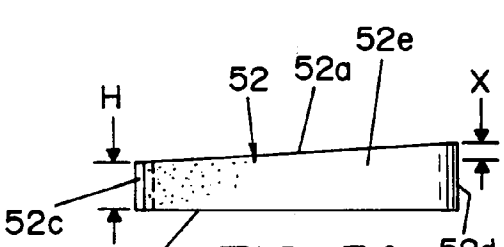

Referring now to FIGS. 4 and 5A, refractory component 52 includes a top surface 52*a*, a planar bottom surface 52*b*, a leading end 52*c*, a trailing end 52*d* and side surfaces 52*e*, 52*f*. As used herein, the term "leading end" shall mean an end of the component at or nearest to the beginning of starter set 50, namely, where starter set 50 will begin the ramping and spiraling of lining bricks 18. The term "trailing end" shall mean the end at or nearest to that end of starter set 50 where a new layer overlaying an existing layer of lining bricks 18 begins. Refractory component 52 is generally arcuate in shape, as best seen in FIG. 4, and is thicker at trailing end 52*d* than at leading end 52*c*, as best seen in FIG. 5A. The thickness "H" of refractory component 52 at its leading edge 52*c* is equal to the thickness of a conventional refractory lining brick 18 that is to be used in forming lining 14 in ladle 10. Trailing end 52*d* of refractory component 52 is dimensioned to have a thickness "X" that is larger than the thickness of a conventional refractory lining brick 18. In this respect, if refractory component 52 is set on a planar surface with a conventional lining brick 18 at each end thereof, trailing end 52*d* of refractory component 52 would project a distance "X" above refractory lining brick 18.

In accordance with the present invention, the leading end 52*c* of refractory component 52 is dimensioned to mate with the adjacent lining brick 18. By way of example and not limitation, lining brick 18 may have a concave or a convex end surface facing refractory component 52. Leading end 52*c* of refractory component 52 would thus be formed to have a convex or concave shape to matingly engage the end surface of lining brick 18. It is contemplated that leading end 52*c* may assume other shapes, such as by way of example and not limitation, a planar configuration or a V-shaped configuration, to mate with the end surface of refractory lining brick 18. In the embodiment shown, leading end 52*c* of refractory component 52 is concave to match a cylindrical convex end of lining brick 18. Trailing end 52*d* of refractory component 52 has a partially cylindrical convex shape.

Referring now to FIGS. 4 and 5B, refractory component 54 is best seen. Refractory component 54 includes a top surface 54*a*, a planar bottom surface 54*b*, a leading end 54*c*, a trailing end 54*d* and side surfaces 54*e*, 54*f*. Refractory component 54 is generally arcuate in shape, as best seen in FIG. 4, and is thicker at its trailing end 54*d* than at its leading end 54*c*, as best seen in FIG. 5B. The thickness of refractory component 54 at its leading end 54*c* is equal to dimension "X," as described above. At its trailing end 54*d*, refractory component 54 has a thickness "Y." As best seen in FIG. 4, leading end 54*c* of refractory component 54 has a concave shape that is dimensioned to mate and conform with the convex surface of end 52*d* on refractory component 52. Trailing end 54*d* of refractory component 54 has a cylindrical convex surface.

Referring now to FIGS. 4 and 5C, refractory component 56 is best shown. Refractory component 56 includes a top surface 56*a*, a planar bottom surface 56*b*, a leading end 56*c*, a trailing end 56*d* and side surfaces 56*e*, 56*f*. As best seen in FIG. 5C, leading end 56*c* of refractory component 56 has a thickness "Y" that is approximately equal to the thickness of trailing end 54*d* of refractory component 54. Trailing end 56*d* of refractory component 56 has a dimension "Z," where trailing end 56*d* of refractory component 56 is thicker than leading end 56*c* thereof. As best seen in FIG. 4, leading end 56*c* of refractory component 56 has a concave cylindrical surface that is dimensioned to mate with the convex cylindrical surface of end 54*d* of refractory component 54. Trailing end 56*d* of refractory component 56 has a convex cylindrical surface, as best seen in FIG. 4.

Referring now to FIGS. 4 and 5D, refractory component 58 includes a top surface 58*a*, a planar bottom surface 58*b*, a leading end 58*c*, a trailing end 58*d* and side surfaces 58*e*, 58*f*. As best seen in FIG. 5, refractory component 58 is arcuate in shape, and is thicker at its trailing end 58*d* than at its leading end 58*c*. The thickness of refractory component 58 at leading end 58*c* has a dimension "Z," that is equal to the thickness of trailing end 56*d* of refractory component 56. Trailing end 58*d* of refractory component 58 is formed to mate with the end surface of an adjacent lining brick 18. In this respect, based upon the shape of the end surface of the adjacent lining brick 18, trailing end 58*d* of refractory component 58 may have a convex, concave, flat or V-shaped configuration. Other shapes are also contemplated. In the embodiment shown, trailing end 58*d* of refractory component 58 is cylindrical and convex in shape to matingly engage the concave end surface of refractory lining brick 18 shown in the drawings. Trailing end 58*d* has a thickness "H" equal to the thickness of refractory bricks 18.

Refractory components 52, 54, 56 and 58 are dimensioned to be assembled end-to-end with refractory component 52 abutting refractory component 54, refractory component 54 abutting refractory component 56, and refractory component 56 abutting refractory component 58. Refractory components 52, 54, 56 and 58 are dimensioned to be assembled wherein upper surfaces 52*a*, 54*a*, 56*a* and 58*a* of the respective components 52, 54, 56 and 58 are in alignment and form a contoured ramp surface. In this respect, upper surfaces 52*a*, 54*a*, 56*a* and 58*a* of refractory components 52, 54, 56 and 58 when joined together form a ramp surface that has a contour, i.e., the ramp surface defined by surfaces 52*a*, 54*a*, 56*a* and 58*a*. In accordance with the present invention, the ramp surface defined by starter set 50 bows upwardly, as best seen in FIG. 3 wherein a dashed line 70 shows the profile of a linear ramp surface. As illustrated in FIG. 3, upper surfaces 52*a*, 54*a*, 56*a* and 58*a* are dimensioned such that when components 52, 54, 56 and 58 are assembled together they form a slightly arched surface, such that when lining bricks 18 are mounted thereon, the last lining bricks 18 that are set upon refractory component 58 are nearly horizontal to adjacent lining brick(s). In the embodiment shown in FIGS. 3–5D, upper surfaces 52*a*, 54*a*, 56*a* and 58*a* are each flat, planar surfaces that are oriented at different angles to produce the outward bow or arch when assembled.

Each component 52, 54, 56 and 58 is formed of a high-temperature refractory material that is suitable for use in a conventional steel ladle. Each component 52, 54, 56 and 58 may be cast or pressed into the desired respective shape. Each component 52, 54, 56 and 58 may be isopressed, hydraulically pressed, mechanically pressed or friction pressed. In a preferred embodiment, each component 52, 54, 56 and 58 is cast.

The present invention shall now be further described with respect to the use and operation of starter set 50. Starter set 50 is assembled by placing refractory component 52 in a course of the conventional ladle lining bricks 18. As illustrated in FIG. 3, leading end 52*c* of component 52 has a height matching the height of the lining bricks 18 used within the ladle. Trailing end 52*d* is dimensioned to extend a distance X above lining bricks 18 that abut trailing end 52*d*. In the embodiment shown, refractory component 52 is dimensioned to replace approximately three conventional lining bricks 18. Refractory component 52 may be placed upon a horizontal surface of bottom lining 22, or may be placed upon a course of lining bricks 18. With refractory component 52 in place within a course of lining bricks 18, refractory component 54 is placed adjacent refractory component 52 such that the leading end 54*c* of refractory component 54 abuts trailing end 52*d* of refractory component 52. In this respect, the concave form of trailing end 54*d* receives the convex trailing end 52*d* of refractory component 52. As illustrated in FIG. 3, component 54 is placed atop of the existing course of lining bricks 18. In similar respects, refractory component 56 is arranged to abut refractory component 54. In this respect, the concave leading end 56*c* of refractory component 56 receives in mating fashion the convex trailing end 54*d* of refractory component 54. Lastly, refractory component 58 is placed upon the existing horizontal course of lining bricks 18. In this respect, the concave leading end of refractory component 58 abuts and mates with trailing end 56*d* of refractory component 56. As mentioned above and as illustrated in FIG. 3, refractory components 52, 54, 56 and 58 form a starter set for creating a spiral brick lining of ladle 10.

Basically, starter set 50 is disposed between a first course "FC" of lining bricks 18 and a second course "SC" of lining bricks 18, as seen in FIG. 3. The first course "FC" is the horizontal course lining bricks 18 that support a portion of starter set 50, and the second course "SC" is a spiraling course that is created or begun by starter set 50. The ramp surface at the leading end of starter set 50 is aligned with the upper surface of lining bricks 18 forming first course "FC." The trailing end of the ramp surface is aligned with the upper surface of lining bricks 18 that form the second course "SC."

Starter set 50 provides an outwardly bowed curve such that the bricks positioned over refractory component 58 assume a near horizontal configuration to abut closely with the corresponding horizontal refractory brick 18 adjacent thereto. Accordingly, rather than a linear ramp as depicted in FIG. 2, starter set 50 forms a smooth, arched ramp that facilitates better matching of adjacent lining bricks 18 thereby avoiding large gaps or openings in the ladle lining. Dashed line 70 shows the slope of a planar, flat ramp surface. As depicted in FIG. 3, the contoured arching profile of the surface of starter set 50 provides a smoother adjustment in the refractory bricks from horizontal courses to a spiral configuration.

Figure 6:
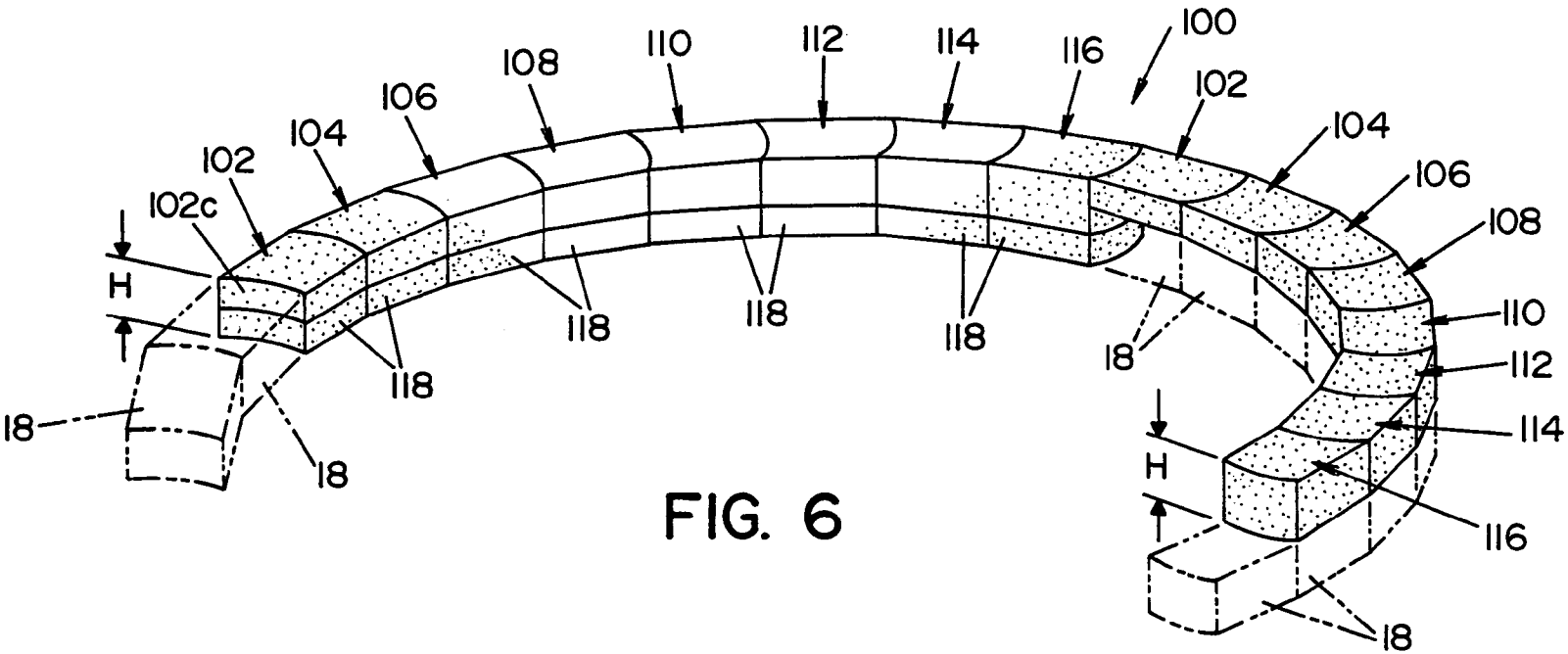
FIG. 6 is a perspective view of a starter set of refractory components for forming a spiral lining within a ladle for holding molten metal, illustrating an alternate embodiment of the present invention.
Figure 7:
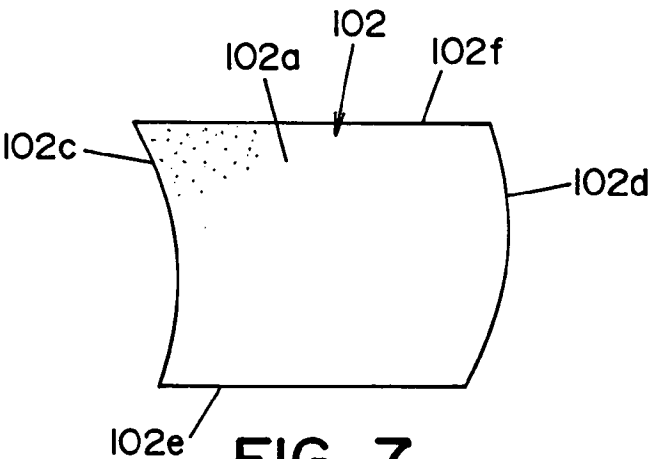
FIG. 7 is a top plan view of a brick from the starter set shown in FIG. 6.
Figure 8:
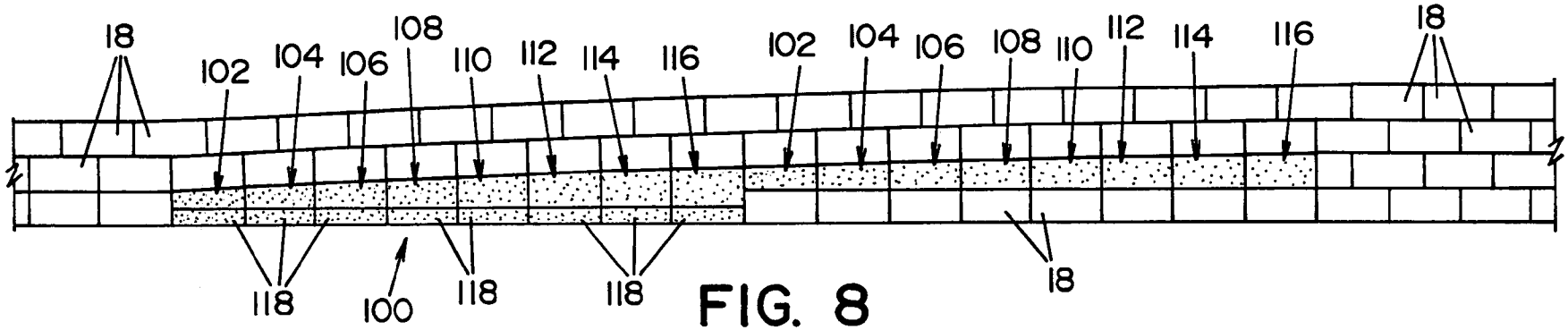
FIG. 8 is a side, elevational view of a starter set of refractory components creating a spiral lining in a ladle that is used for handling molten metal, illustrating an alternate embodiment of the present invention.

Referring now to FIGS. 6, 7 and 8, an alternate embodiment of the present invention is shown. In FIGS. 3–5D, a starter set comprised of four (4) refractory components, is shown. In FIGS. 6–8, a starter set 100 comprised of twenty-four (24) refractory components having nine different shapes is shown. In FIG. 6, like shaped components are identified with like reference numbers. As illustrated in FIG. 6, starter set 100 is comprised of two groups of eight components 102, 104, 106, 108, 110, 112, 114 and 116 and a third group of eight like components 118. As illustrated in FIG. 6, refractory components 118 have a thickness approximately equal to one-half the height of conventional lining bricks 18. Refractory component 102 has a leading end 102*c* that has a height approximately equal to one-half the height of a conventional lining brick 18, such that when component 102 is stacked upon component 118, the leading ends of components 102, 118 together have a total height "H" equal to the height of a conventional refractory brick, as illustrated in FIG. 6. Components 102, 104, 106, 108, 110, 112, 114 and 116 are shaped to be higher than the preceding bricks such that the trailing end of a brick abuts the leading end of the next successive brick to form a continuous ramp surface, as illustrated in FIG. 8. As with starter set 50, refractory components 102–118 of starter set 100 are dimensioned to define a continuous ramp surface that has an outward, i.e., upward, bow or arch wherein the last refractory component 116 in starter set 100 abuts and mates with a conventional lining brick 18 and has a ramp surface that orients bricks stacked thereon in a generally horizontal position as they approach the end of starter set 100 so as to eliminate and avoid any cracks or gaps forming in the ladle lining.

FIGS. 6–8 illustrate how the number of refractory components forming a starter set according to the present invention may vary, The respective components are shaped such that the upper end surface is contoured wherein the trailing end more closely aligns the lining bricks stacked thereon in a near horizontal position to match and mate more closely with the horizontal lining bricks in the next course of lining bricks.

Figure 9:
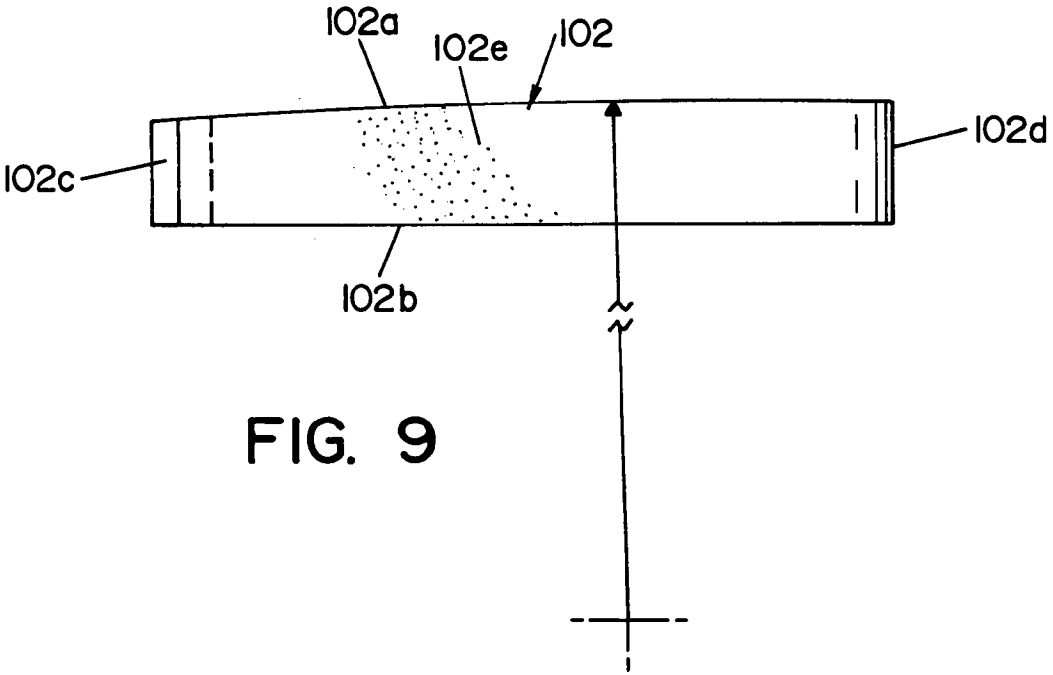
FIG. 9 is a side, elevational view of a brick from the starter set shown in FIG. 8, illustrating the radius upper surface of a brick used in such starter set.

Starter sets 50 and 100 described heretofore include refractory components having generally flat, upper surfaces. As illustrated in FIG. 9, the upper surface of a refractory component used in a starter set according to the present invention may have a rounded or curved upper surface to more closely approximate a smooth contour when assembled with adjacent starter set components.

Figure 10:
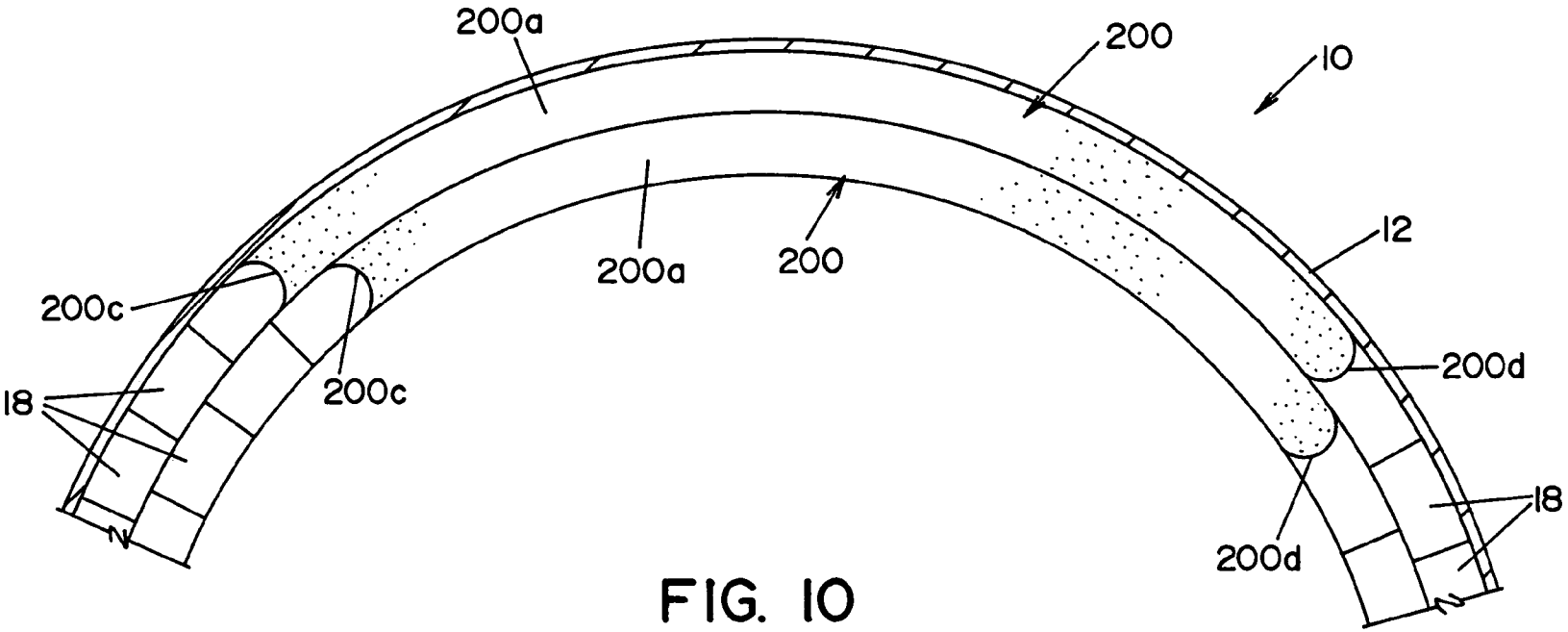
FIG. 10 is a plan view of two starter elements, disposed side-by-side within a ladle.
Figure 11:
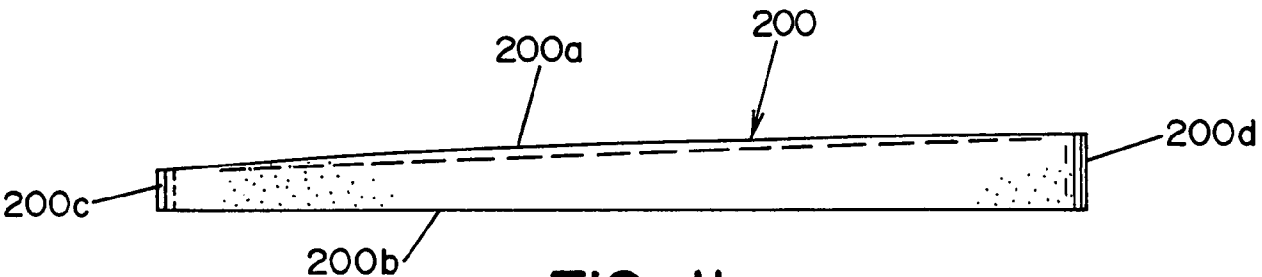
FIG. 11 is a side, elevational view of a starter element shown in FIG. 10.

Still further, each starter set 50 and 100, as described heretofore, is comprised of a plurality of refractory components. FIGS. 10 and 11 illustrate a starter element 200 that is a one-piece component dimensioned to start a spiral brick lining in ladle 10. Starter element 200 has a top surface 200*a*, a bottom surface 200*b*, a leading end 200*c* and a trailing end 200*d*. Starter element 200 is generally arcuate in shape, and is preferably dimensioned to fit along the inner surface of metallic shell 12, as illustrated in FIG. 10. Leading end 200*c* has a thickness equal to the thickness of a lining brick 18. Trailing end 200*d* has a thickness equal to twice the thickness of a lining brick 18. In other words, trailing end 200*d* has a thickness equal to the thickness of two lining bricks 18 stacked one upon the other.

Leading end 200*c* and trailing end 200*d* are dimensioned to mate with the end surfaces of an adjacent lining brick 18. In this respect, based upon the shape of the end surface of an adjacent lining brick, leading end 200*c* and trailing end 200*d* may have a convex, concave, flat or V-shaped configuration. Other shapes are also contemplated. In the embodiment shown, leading end 200*c* is shown with a concave configuration to matingly engage a convex end surface on an adjacent lining brick 18. Trailing end 200*d* has a convex shape dimensioned to matingly engage a concave end surface of a refractory lining brick 18.

Bottom surface 200*b* is generally flat to be positioned on a planar surface of metallic shell 12, or on a planar surface defined by a course of lining bricks 18. Upper surface 200*a* of starter element 200 is contoured and bows upwardly to form a slightly arched surface, such that lining bricks may be stacked thereon, wherein the lining bricks on the trailing end 200*d* of starter element 200 are nearly horizontal and merge with the adjacent lining brick without creating any gaps therebetween.

Starter element 200 is formed of a high-temperature refractory material that is suitable for use in a conventional steel ladle. Starter element 200 may be cast or pressed into the desired shape. Starter element 200 may be isopressed, hydraulically pressed, mechanically pressed or friction pressed. In a preferred embodiment, starter element 200 is cast.

The foregoing description describes specific embodiments of the present invention. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A starter set of refractory components for starting a spiral brick lining in a ladle used for handling molten metal, said starter set comprised of:

a plurality of refractory components, each component having a planar bottom surface, an upper surface and end surfaces, said components dimensioned to be arranged end-to-end wherein the end surface of a component facing an adjacent component is dimensioned to mate with the end surface of said adjacent component, and wherein the upper surfaces of said refractory components are alignable to form a continuous, inclined upper surface profile having a leading end and a trailing end, said upper surface profile sloping upwardly from said leading end to said trailing end and being upwardly bowed wherein refractory bricks set onto said upper surface profile are nearly horizontal at the trailing end of said upper surface profile.

2. A starter set as defined in claim 1, wherein said upper surface profile is arched.

3. A starter set as defined in claim 1, wherein each of said component has a flat, upper surface.

4. A starter set as defined in claim 1, wherein each of said component has a contoured, upper surface.

5. A starter set as defined in claims 3 or 4, wherein said starter set has four (4) components.

6. A starter set as defined in claim 5, wherein said refractory components are cast refractory pieces.

7. A starter set as defined in claim 5, wherein said refractory components are isopressed refractory pieces.

8. A starter set as defined in claim 5, wherein said refractory components are mechanically or hydraulically pressed.

9. A starter set as defined in claim 5, wherein one of said components is dimensioned to be disposed in a course of bricks in said ladle and three of said components are dimensioned to be disposed on said course of bricks.

10. A starter set of refractory components for starting a spiral course of lining bricks in a ladle used for handling molten metal, said starter set comprised of a plurality of refractory components dimensioned to be assembled together to form a non-linear, contoured ramp surface having a leading end and a trailing end, said refractory components dimensioned such that said contoured ramp surface is slightly arched between said leading end and trailing end and said leading end of said ramp surface is alignable with an upper surface of a first course of lining bricks in said ladle and said trailing end of said ramp surface is alignable and substantially coplanar with an upper surface of a second course of lining bricks in said ladle, said second course of lining bricks being disposed on said first course of lining bricks.

11. A starter set as defined in claim 10, wherein said starter set is comprised of four (4) components.

12. A starter set as defined in claim 10, wherein said ramp surface is contoured such that said ramp surface at said trailing end is nearly horizontal.

13. A starter set as defined in claim 10, wherein each of said refractory components has a planar upper surface.

14. A starter set as defined in claim 10, wherein each of said refractory components has a contoured, upper surface.

15. A lining for a ladle used to handle molten metal, said lining comprised of:

a first course of like, refractory bricks arranged horizontally in said ladle, said first course having an upper surface;

a second course of said like refractory bricks arranged to spiral within said ladle, said second course disposed on said first course, and said second course having an upper surface; and a starter comprised of at least one refractory component, dimensioned to form a contoured ramp surface, said starter being disposed between said first course and said second course of like refractory bricks, said ramp surface at one end of said starter set aligned with said upper surface of said first course and said ramp surface at another end aligned with said upper surface of said second course, said ramp surface being arched between said one end and said other end such that refractory bricks set on said other end of said ramp surface are substantially horizontal.

16. A lining as defined in claim 15, wherein said starter is comprised of a plurality of refractory components that are dimensioned to be assembled together.

17. A lining as defined in claim 16, wherein each of said refractory components has a leading end and trailing end, said ends dimensioned such that adjacent ends of said refractory components mate with each other.

18. A lining as defined in claim 15, wherein said starter is comprised of four (4) components.

19. A lining as defined in claim 18, wherein each of said four (4) components has a flat, upper surface.

20. A lining as defined in claim 18, wherein each of said four (4) components has a contoured, upper surface.

* * * * *